United States Patent [19]

Ford

[11] 4,094,408

[45] June 13, 1978

[54] CONTAINERS FOR PILLS AND THE LIKE

[76] Inventor: John B. Ford, 6118 Webber-Cole Rd., Kinsman, Ohio 44428

[21] Appl. No.: 768,141

[22] Filed: Feb. 14, 1977

[51] Int. Cl.[2] ..... B65D 83/04

[52] U.S. Cl. ..... 206/534; 206/535; 220/4 D; 220/306

[58] Field of Search ..... 116/121; 206/379, 459, 206/534–537; 215/206, 230, 365–366; 220/4 D, 306

[56] References Cited

U.S. PATENT DOCUMENTS

| | | | |
|---|---|---|---|
| 2,256,257 | 9/1941 | Dukehart, Jr. | 206/536 X |
| 2,707,552 | 5/1955 | Matthiesen | 206/537 |
| 2,739,564 | 3/1956 | North | 116/121 |
| 2,759,598 | 8/1956 | Tregilgas | 206/537 |
| 2,767,680 | 10/1956 | Lermer | 206/536 X |
| 3,151,599 | 10/1964 | Livingston | 215/230 X |
| 3,227,127 | 1/1966 | Gayle | 215/230 X |
| 3,567,085 | 3/1971 | Flores | 206/536 X |

FOREIGN PATENT DOCUMENTS

| | | | |
|---|---|---|---|
| 700,561 | 12/1964 | Canada | 206/535 |

*Primary Examiner*—Steven E. Lipman
*Attorney, Agent, or Firm*—Michael Williams

[57] ABSTRACT

The improved pill container has an external shape simulating a fountain pen and includes the usual clip for securing the container within a pocket of a user. Construction-wise, the container includes a center section and two end sections. Each of the end sections is hollow and adapted to contain pills or medication of a certain type, and each end section has an open end which fits telescopically over a portion of the center section so that the end section is rotatably mounted. Cooperating projection and recess means are provided to yieldably retain each end section to the center section and to provide for step-by-step rotation of the end section. Indicating means are provided to visually indicate the rotated position of each end section. The center section blocks flow of pills from one end section to the other.

3 Claims, 5 Drawing Figures

FIG. 3.
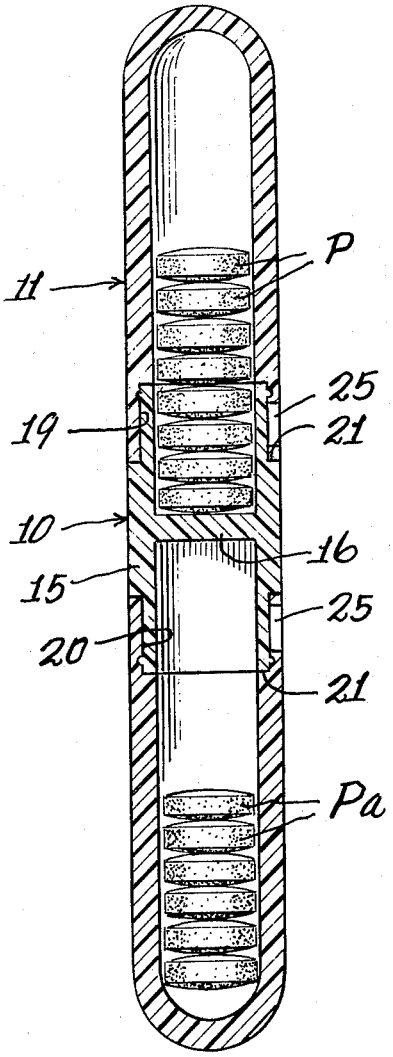
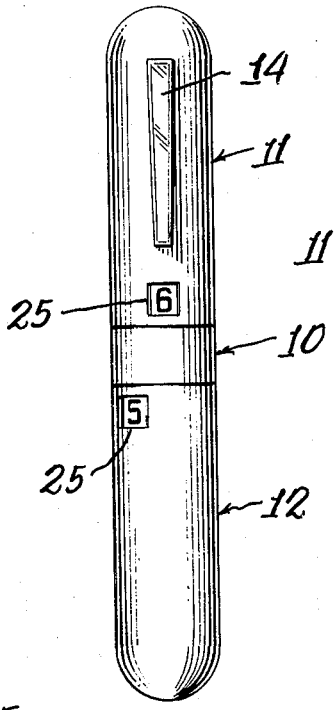
FIG. 1.
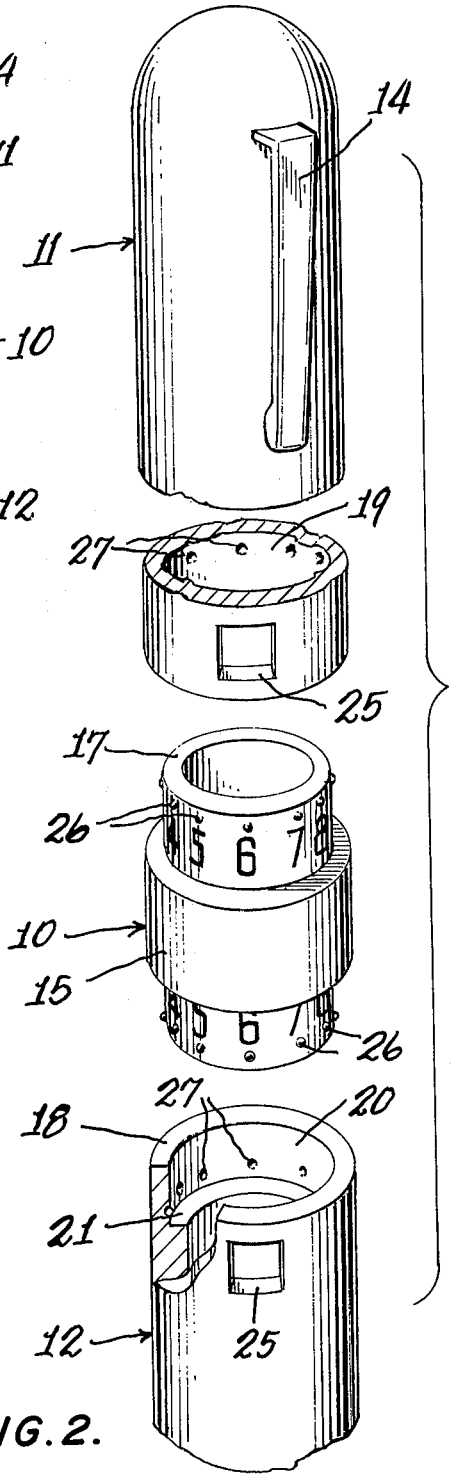
FIG. 2.

CONTAINERS FOR PILLS AND THE LIKE

BACKGROUND AND SUMMARY

The prior art includes several patents disclosing pocket-type pill holders but, insofar as I am aware, none has received any commercial success. Some of these prior art devices have only one compartment for pills, while the multi-compartment containers are of complicated construction and therefore costly to manufacture.

My improved pill container includes only three main components, namely, a center section and two end sections. The center section is circular in transverse section and H-shaped in longitudinal section. The end sections are in the form of elongated barrels, with one end open and the opposite end closed. The open end of an end section is adapted to fit telescopically over a respective end of the center section so that it may be rotated relative to the latter, and the end sections are of identical construction and adapted to fit with either end of the center section. The container may be of the shape of an ordinary fountain pen and may be worn in a pocket like a pen. Thus, the container is readily available to a person who must always carry a supply of pills.

DESCRIPTION OF THE DRAWINGS

In the drawings accompanying this specification and forming a part of this application there are shown, for purpose of illustration, embodiments which my invention may assume, and in these drawings:

FIG. 1 is an elevational view of a presently preferred embodiment of my invention, FIG. 2 is an enlarged, fragmentary perspective view, showing components of the container in separated relation, FIG. 3 is a longitudinal sectional view through the container, showing the components in assembled relation.

DESCRIPTION OF THE PREFERRED EMBODIMENT

Figure 4:
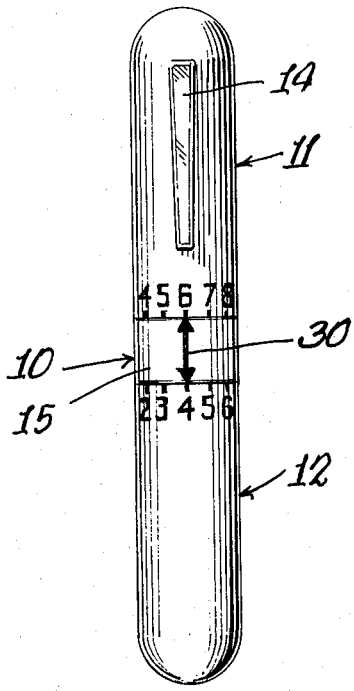
FIG. 4 is an elevational view of another embodiment of my invention.

My improved pill container, as seen in FIG. 1, has an outside appearance somewhat like a conventional fountain pen. However, unlike a fountain pen, my container comprises a center section 10 and two end sections 11 and 12. One of the end sections, such as the section 11, may carry a clip 14 of conventional form, for holding the container within the pocket of a person. The sections 10, 11 and 12 are preferably formed of molded plastic, and the end sections may be of clear plastic so that a user may readily see the supply of pills therein.

As seen in FIGS. 2 and 3, the center section 10 has a central portion 15 of an outside diameter substantially equal to the outside diameter of the end sections to produce a barrel having a uniform exterior so that it will not catch on any part of the pocket when it is being inserted into or removed therefrom. The center section has a cross-wall 16 (see FIG. 3) which separates two tubular portions 17 and 18 that extend from opposite sides of the central portion 15.

The outer shape of the center section and the end sections is shown as cylindrical, although these sections may assume any other exterior shape. However, the tubular portions 17 and 18 must be cylindrical and they match with and are received within corresponding circular recesses 19 and 20 formed in respective end sections 11 and 12. The tubular portions 17 and 18 are of reduced diameter with respect to the central portion 15 and extend inwardly of the respective opposite ends of the center section 10 to provide inner annular shoulders 21 against which the surface defining the open end of an end section abuts.

The exterior surface of each tubular portion 17 or 18 is provided with indicia, such as the numbers seen in FIG. 2. Each end section adjacent to its open end, is provided with a window 25 which, when the end sections are assembled with the center section, are horizontally aligned with the numbers and are adapted to display a selected number therethrough.

The end sections may fit on the tubular portions 17, 18 with a friction fit, so that the end sections may be rotated to any particular position and will remain in such position. However, it is preferred to employ means which will offer resistance to rotation and provide a "click" movement of an end section from one number to another. As best seen in FIG. 2, such means comprise a series of small projections 26 on each tubular portion 17 and 18, and a series of small recesses 27 formed in the inner wall of such tubular portions and adapted to receive respective projections.

If desired only one projection (or recess) may be formed on a tubular portion to cooperate with a series of recesses (or projections) on the end section. The projections 26 are aligned with respective numbers, so as an end section is rotated in step-by-step fashion, as dictated by the seating of the projections within the recesses, the window 25 in each end section is aligned with a number and the latter is visible through the window.

The numbers may be arranged in numerical order (such as from 1 to 10) to indicate the hours of the day when medication is to be taken, or to indicate the number of pills that have been taken. As seen in FIG. 2, pills P are contained in the upper section 11 and pills Pa, which may be of different type, are contained within the lower section 12, the cross wall 16 of the center section keeping the pills separated.

DESCRIPTION OF THE OTHER EMBODIMENT

Figure 5:
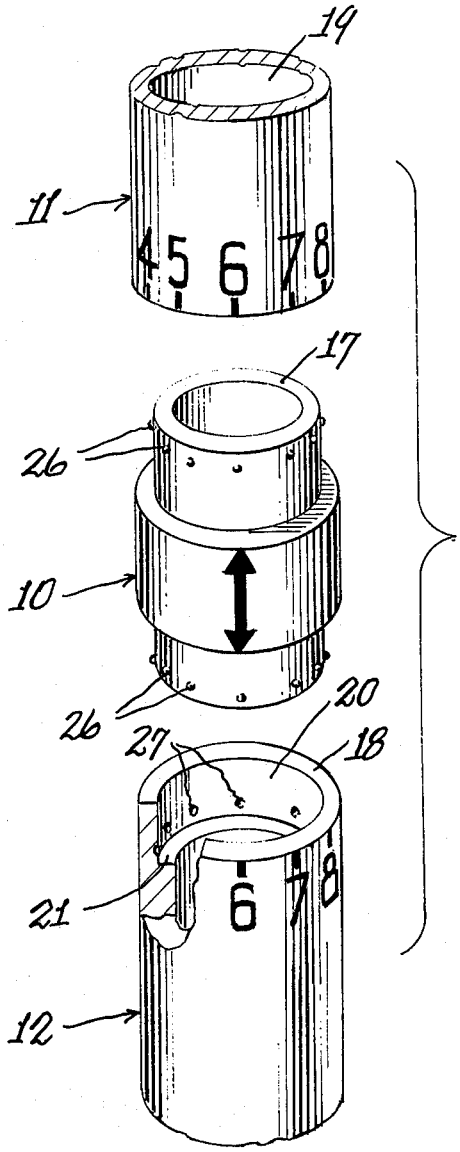
FIG. 5 is an enlarged, fragmentary perspective view, showing the components of the embodiment of FIG. 4 in separated relation.

The embodiment shown in FIGS. 4 and 5 is quite similar to that shown in FIGS. 1 through 3, and like reference numerals will indicate like parts. The difference in this embodiment is that the numerals appear on the outside surface of the end sections 11 and 12, near the openings therein, and these numerals are adapted to be aligned with a double-headed arrow 30 appearing on the outside surface of the central portion 15. In this embodiment, the windows 25 are omitted.

I claim:

1. A container for carrying medical capsules, pills, and the like on one's person for handy and convenient use, comprising:

a tubular center section and two tubular end sections connected to opposite ends of said center section in axially aligned relation, said center section being H-shaped in longitudinal section and providing tubular cylindrical portions at its opposite ends and an intermediate transverse wall which blocks communication between the interior of said cylindrical portions, each of said end sections being in the form of an elongated barrel adapted to contain pills and the like, each barrel being closed at an outer end and open at an inner end, the open inner end of each barrel having a smooth surfaced cylindrical recess of a size closely and rotatably receiving a respective one of said center section cylindrical portions thereby to effect assembly of said end sections with said center section, with the interiors of said end sections isolated from each other by said transverse wall, said center section cylindrical portions and said end section cylindrical recesses having like diameters whereby either said end section may be cooperatively associated with either end of said center section, each said center section cylindrical portion having a circumferential series of uniformly spaced projections and each said cylindrical recess of said end sections having a complementary series of circumferentially uniformly spaced projection-receiving recesses, thereby effecting snap fit association of said end sections with said center section and further retaining either said end section in a selected rotational position with respect to said center section, and, indicia associated respectively with each said end sections and said center section and circumferentially related to said projections and recesses for indicating selected rotational positions of said center and end sections with respect to each other.

2. The container of claim 1 wherein said indicia are carried by said cylindrical portions of said center section, and said end sections are each apertured to form a window adjacent its said inner end through which said indicia are visible.

3. The container of claim 1 wherein said indicia are carried by each said end section on the exterior periphery thereof and include an alignment indicator mark provided on the exterior surface of said center section.

* * * * *